United States Patent [19]

Stahlecker

[11] Patent Number: 4,892,422

[45] Date of Patent: Jan. 9, 1990

[54] SUPPORT ASSEMBLY FOR THE ROTOR OF AN OPEN END YARN SPINNING APPARATUS

[75] Inventor: Peter H. Stahlecker, Charlotte, N.C.

[73] Assignee: American Suessen Corporation, Charlotte, N.C.

[21] Appl. No.: 226,673

[22] Filed: Aug. 1, 1988

[51] Int. Cl.[4] ..... D01H 1/24; F16C 13/00

[52] U.S. Cl. ..... 384/549; 57/406; 384/295

[58] Field of Search ..... 301/18, 19, 20, 21, 301/22, 153, 384, 194; 384/58, 281, 295, 449, 548; 57/103, 406

[56] References Cited

U.S. PATENT DOCUMENTS

| | | | |
|---|---|---|---|
| 1,439,424 | 12/1922 | Knudsen | 301/22 |
| 4,667,464 | 5/1987 | Stahlecker et al. | 57/406 |
| 4,713,932 | 12/1987 | Zott | 57/406 |

FOREIGN PATENT DOCUMENTS

| | | | |
|---|---|---|---|
| 1388323 | 3/1964 | France | 301/22 |

*Primary Examiner*—Thomas R. Hannon

*Attorney, Agent, or Firm*—Bell, Seltzer, Park & Gibson

[57] ABSTRACT

A support assembly is disclosed which is adapted to be mounted in adjacent pairs to form a wedge shaped cusp for rotatably supporting a shaft of a spinning rotor of an open end yarn spinning apparatus. The assembly includes a support shaft, a bearing mounted on the shaft, and a pair of discs mounted on the shaft on respective opposite sides of the bearing. Each disc comprises an annular metal body member which is mounted upon the support shaft by a press fit, and an annular ring assembly mounted coaxially upon the other periphery of the body member by a self-holding but readily releaseable interconnection. The ring assembly includes an inner metal ring, and an outer plastic ring which is fixedly mounted to the inner metal ring, and the releasable interconnection of the ring assembly to the body member permits the ring assembly to be readily replaced when the plastic ring becomes worn from use, and without releasing the press fit between the body member and support shaft.

18 Claims, 2 Drawing Sheets

SUPPORT ASSEMBLY FOR THE ROTOR OF AN OPEN END YARN SPINNING APPARATUS

BACKGROUND OF THE INVENTION

The present invention relates to a support assembly adapted for rotatably supporting a shaft of a spinning rotor of an open end yarn spinning apparatus.

Conventional open end yarn spinning machines comprise a plurality of side-by-side spinning positions. Each spinning position has a spinning rotor which is rotated at high speed, and which receives the yarn fibers from a fiber feed duct and forms a band of fibers which is subsequently withdrawn as a twisted yarn. The rotor includes a coaxial rotor shaft which extends from the rearward side of the rotor, and the shaft is most commonly supported for rotation by a so-called "twin disc" bearing arrangement composed of two support assemblies mounted in adjacent pairs to form a wedge shaped cusp for rotatably supporting the shaft of the rotor.

Each support assembly of the above described type typically comprises a pair of axially spaced apart discs, which are mounted on a common support shaft, and each support shaft is in turn mounted to the frame of the machine by means of a suitable bearing which is fixed on the support shaft and releasably mounted to the machine frame, so that the support shaft and discs are freely rotatable. Rotation is imparted to the rotor shaft by contact with a drive belt, which advances along the length of the machine, and so that rotation is also imparted to the discs and support shafts of the two support assemblies.

The discs of the support assemblies each comprise a solid metal wheel which is joined to the common support shaft by a press fit, and the outer periphery of the wheel mounts a tire of plastic or other hard rubber-like material, and which directly supports the shaft of the spinning rotor. As will be readily understood, the tires of the discs wear out in time, such as about once a year, and it is present practice to change the tires by initially withdrawing the rotor and then removing each support assembly from the frame of the apparatus. Once each support assembly is removed, the discs with the worn tires are removed from the support shaft at the press fit and discarded, and new discs with new tires are installed on the support shaft by a new press fit. The assembly is thereafter repositioned in the frame of the apparatus.

As will be apparent, the repeated removal and reconnection of the press fit between the wheels of the discs and the support shaft is not only a labor intensive operation, but it can also result in the scoring of the support shaft and wheel bore, which can lead to imbalances, and also to the deterioration and release of the press fit, thereby requiring that the shaft and bearing be discarded before the end of the useful life of the bearing. Also, the fact that the entire disc is discarded with the worn tire results in the loss of the relatively expensive metallic wheel and thus increases the expense of the operation.

It is accordingly an object of the present invention to provide a support assembly for rotatably supporting the shaft of a spinning rotor of an open end yarn spinning apparatus, and which effectively avoids the above noted limitations and disadvantages of the present constructions.

It is a more particular object of the present invention to provide a support assembly of the described type which permits the plastic tires of the discs to be readily changed when the plastic tires become worn, while avoiding the need to remove the wheels of the discs from the support shaft, and so that the press fit on the support shaft is not disturbed.

It is also an object of the present invention to provide a support assembly of the described type which permits the tires to be replaced upon becoming wore, without loss of a significant amount of metallic material, to thereby minimize the expense of the tire replacing operation.

SUMMARY OF THE PRESENT INVENTION

These and other objects and advantages of the present invention are achieved in the embodiments illustrated herein by the provision of a support assembly which comprises a metallic support shaft defining a central axis, a bearing mounted on the shaft for rotatably mounting the shaft to the frame of the yarn spinning apparatus, and a pair of discs mounted to the support shaft on respective opposite sides of the bearing. Each of the discs comprises a metallic annular body member having a central bore coaxially receiving the shaft so as to be fixedly mounted thereto, and with the body member having an annular outer surface which is concentric to the central bore and to the central axis of the shaft. An annular ring assembly is mounted coaxially upon the outer surface of the body member, with the ring assembly comprising an annular inner metal ring and an annular outer plastic ring which is fixedly mounted upon the metal ring. More particularly, the metal ring has an outer peripheral surface, and an inner surface which contacts and engages the outer surface of the body member so as to form a self-holding and readily releaseable interconnection between the metal ring and the body member, and the plastic ring is mounted upon the outer peripheral surface of the metal ring.

The support shaft is preferably fixedly received in the central bore of the body member by means of a press fit. Also, in one embodiment of the invention, the outer surface of the body member and the mating inner surface of the metal ring of each disc are both cylindrical and are releasably interconnected by means of relatively loose or cold press fit, and such that the interconnection may be easily released upon application of a relatively small axial force. In another embodiment, the outer surface of the body member and the mating inner surface of the metal ring of each disc are both conical, with the angle of the conical surfaces being such as to form a self holding and releasable interconnection upon being pressed together.

Thus, in accordance with the present invention, the ring assembly of each disc may be easily removed as a unit from the associated body member upon the plastic ring becoming worn, by releasing the self-holding interconnection between the ring assembly and the body member. A replacement ring assembly with a new plastic ring may then be mounted upon the body member. Alternatively, the worn plastic ring may be removed from the metal ring, and a new plastic ring assembled to the original metal ring and joined by vulcanization if necessary, and with the original metal ring and new plastic ring then being rejoined to the body member. Thus in neither case is the bearing of the assembly subjected to the heat of vulcanization, nor is the connection between the body member and support shaft disturbed.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
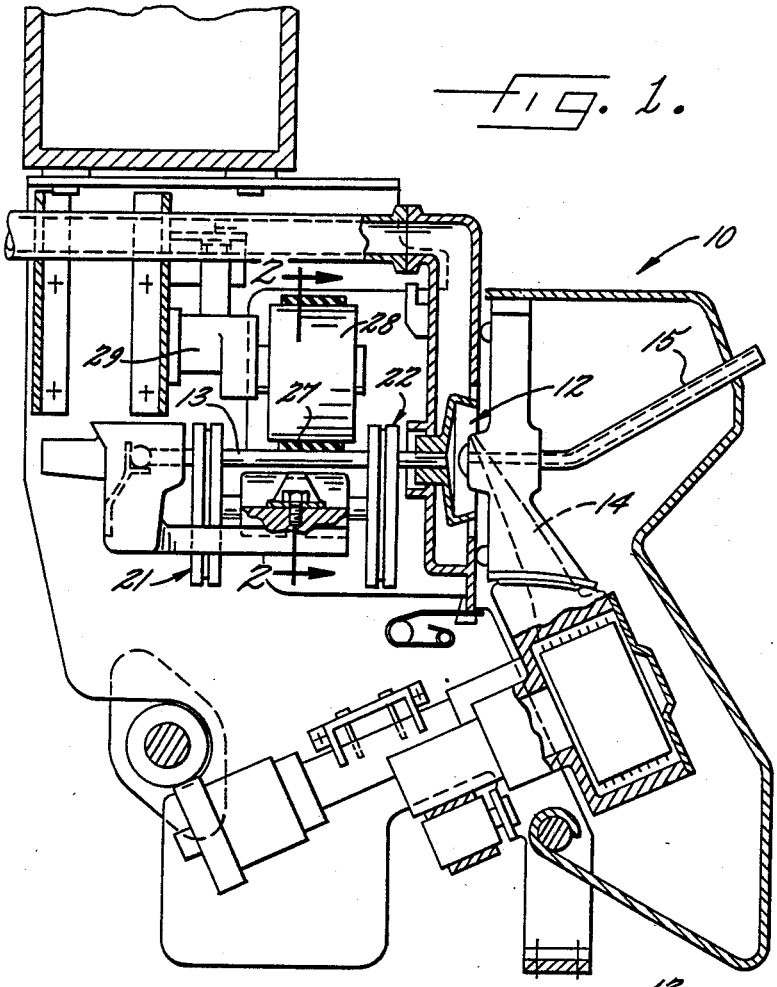
FIG. 1 is a sectional view of an open end yarn spinning apparatus and taken through the center of a spinning position, and which embodies the features of the present invention.
Figure 2:
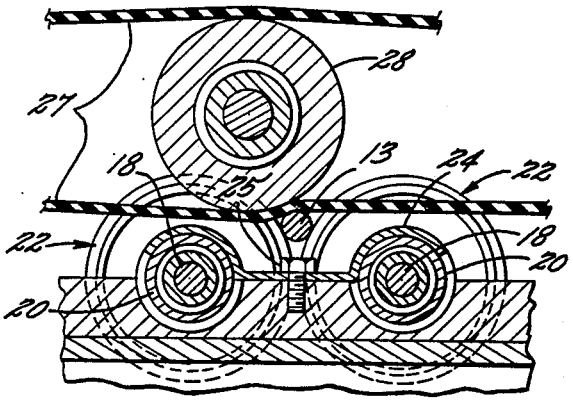
FIG. 2 is a fragmentary sectional view of a pair of support assemblies and associated rotor shaft and tensioning roll, and taken substantially along the line 2—2 of FIG. 1.

Referring more particularly to the drawings, FIG. 1 illustrates one yarn spinning position of an open end yarn spinning machine 10, it being understood that the machine 10 is composed of a number of such positions disposed in a side-by-side relationship along the length of the machine. Each spinning position includes a spinning rotor 12 having an open forward side facing toward the right in FIG. 1, and a rearward side having a rotor shaft 13 coaxially fixed thereto. The rotor 12 is rotated at very high speeds, and the open side of the rotor receives individual yarn fibers from a fiber feed duct 14, to form a band of fibers which is subsequently withdrawn as a twisted yarn through the yarn delivery duct 15, in the manner well known in the art. The resulting yarn is then wound by a take-up system (not shown) into a wound package.

Figure 3:
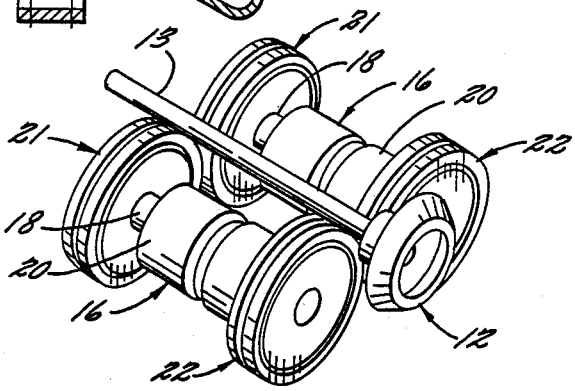
FIG. 3 is a fragmentary perspective view of two support assemblies and associated spinning rotor and shaft, in accordance with the present invention.

The shaft 13 of the spinning rotor 12 is horizontally mounted by a "twin disc" bearing arrangement which includes two support assemblies 16 as best seen in FIG. 3, with each support assembly comprising a support shaft 18 defining a central axis, a bearing 20 mounted on the shaft 18 for rotatably mounting the shaft to the frame of the yarn spinning apparatus, and a pair of discs 21, 22 mounted to the support shaft 18 on respective opposite sides of the bearing 20. The two support assemblies 16 are releasably secured to the frame of the apparatus by a clamping bracket 24 which engages an annular slot which extends about each of the bearings of the two aassemblies. The bracket 24 is in turn releasably secured to the frame by the bolt 25.

The discs 21, 22 of the two support assemblies 16 are laterally aligned so as to support the rotor shaft 13 in a wedge-like cusp formed between the outer surfaces of each laterally adjacent pair of discs, and as best seen in FIG. 3. The rotor shaft 13 is directly driven by a tangential belt 27, which extends in the longitudinal direction of the machine 10, and which also drives the shafts of the rotors of the other spinning positions of the machine. The tangential belt 27 is biased toward the shaft by a tensioning roll 28, which is supported by a pivot arm 29 and which is biased downwardly by a suitable spring (not shown). The spinning apparatus as described above is generally conventional, and is manufactured by W. Schlafhorst & Co., of Germany, under the trade designation Spinncenter Autocoro. A further description may also be obtained from U.S. Pat. No. 4,516,396 to Stahlecker et al.

Figure 4:
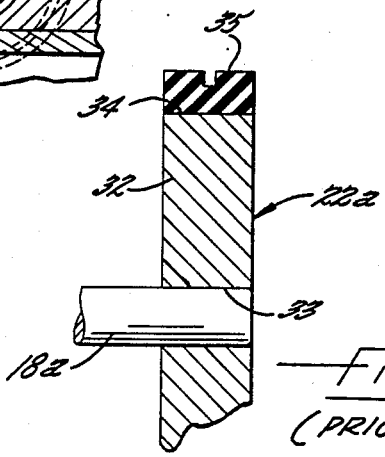
Fig. 4. (PRIOR ART)
FIG. 4 is an enlarged sectional view of one of the discs of the type shown in FIG. 3, but in accordance with the prior art.
Figure 5:
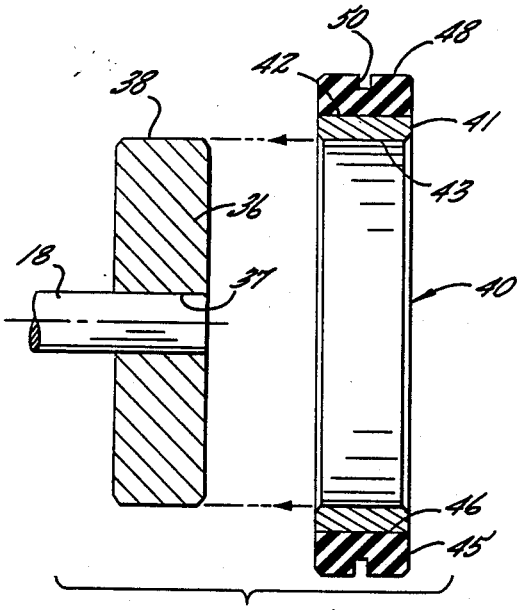
FIG. 5 is an exploded sectional view of a disc in accordance with the present invention.

In accordance with the prior art, and as seen in FIG. 4, the disc of one of the two support assemblies is indicated at 22*a*, and each such disc comprises a wheel 32 which has a central bore 33 which is received on the support shaft 18*a* by means of a press fit, and with the wheel defining an outer cylindrical surface 34. A plastic tire 35 is secured directly to the outer peripheral surface of the wheel 32. To effect replacement of a worn tire, it is necessary to apply sufficient axial force to the disc in order to release the press fit on the shaft 18*a*, which results in the disadvantages noted above. Further details of the structure of a conventional disc of this type may be obtained from U.S. Pat. No. 4,676,673 to Stahlecker et al.

In accordance with the present invention, each of the discs 21, 22 of each support assembly 16 comprises an annular body member 36 which has a central bore 37 which is fixedly mounted to the support shaft 18 by a press fit or the like, and which has an outer cylindrical surface 38 which is concentric to the central axis of the shaft 18.

Figure 6:
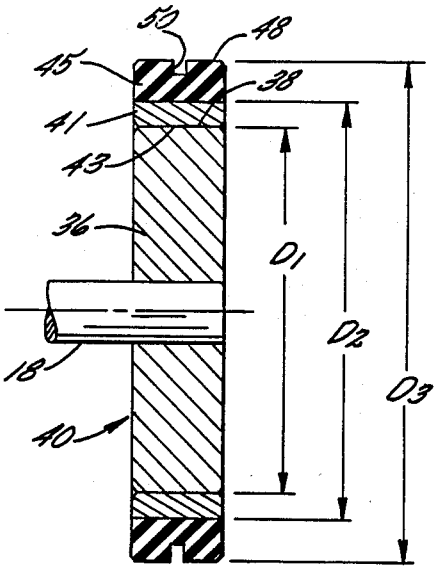
FIG. 6 is a view similar to FIG. 5 but illustrating the disc in assembled relationship.
Figure 7:
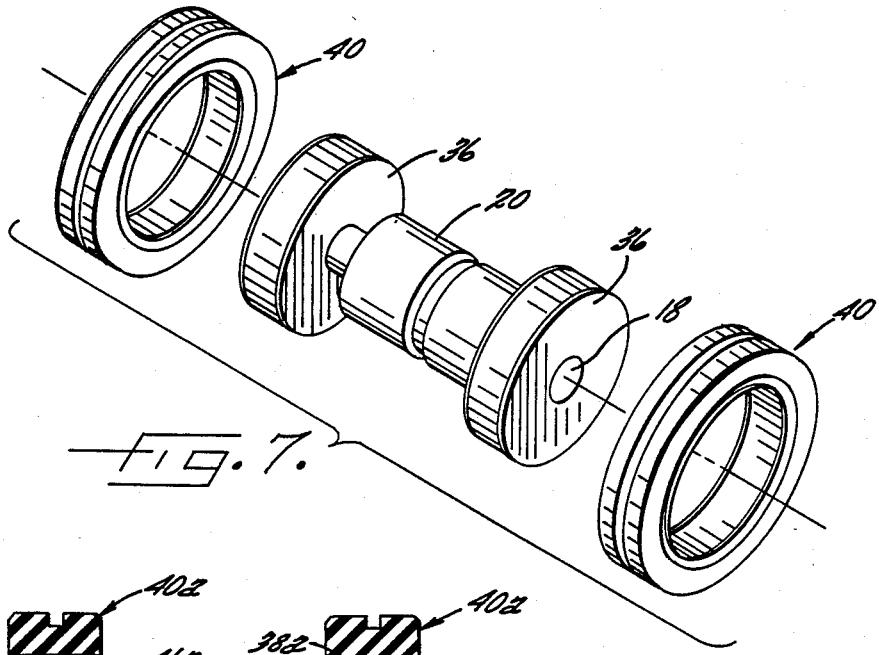
FIG. 7 is an exploded perspective view of a support assembly which embodies the features of the present invention.

Each disc 21, 22 also includes a separable ring assembly 40 which includes an annular metal ring 41 which is mounted coaxially upon the outer surface 38 of the body member 36, with the ring 41 having an outer peripheral surface 42 and an inner surface 43. The surfaces 42 and 43 are both cylindrical and are coaxial with the axis of the shaft 18 and bore 37. The ring assembly 40 further includes an outer plastic ring 45 which is fixedly mounted upon the outer cylindrical surface 42 of the ring 41. The plastic ring 45 includes an inner cylindrical surface 46 which is bonded or otherwise secured upon the surface 42 of the metal ring 41, and the ring 45 also includes an outer cylindrical surface 48. In assembled relation as shown in FIG. 6, the inner surface 43 of the metal ring contacts and engages the outer surface 38 of the body member by means of a relatively loose or cold press fit, and such that the ring assembly 40 may be removed from the body member 36 by a relatively small axially applied force.

In one specific and preferred embodiment of the invention, the body member 36 and the metal ring 41 are both formed of lightweight aluminum. Also, certain geometric relationships between the radial dimensions of the body member 36, the metal ring 41, and the plastic ring 45 are preferred, and which result in the cold press fit being located radially from the central axis a distance sufficient to insure an adequate interconnection. Specifically, the ratio between the radial dimension of the body member 36 and the radial thickness of the metal ring 41 should be greater than about 10, and preferably between about 14 to 15. Also, the ratio of the radial dimension of the body member 36 to the radial thickness of the ring assembly 40 should be at least about 4 and preferably between about 4 to 5. This latter ratio also applies to the ratio of the radius of the inner surface 43 of the metal ring 41 to the radial thickness of the ring assembly 40. Finally, the ratio of the radial thickness of the plastic ring 45 to the radial thickness of the metal ring 41 should be greater than 1 and preferably about 2.

In one specific embodiment, the outer diameter $D_1$ (FIG. 6) of the outer cylindrical surface 38 of the body member is 58 mm, the outer diameter $D_2$ of the metal ring 41 is 62 mm, and the outer diameter $D_3$ of the plastic ring 45 is 70 mm. To provide the above described relatively loose or cold press fit between the outer surface 38 of the body member 36 and the inner surface 43 of the metal ring 41, the outer surface 38 of the body member has a diameter tolerance in accordance with DIN (German Industrial Standards) tolerance H7 which prescribes that the surface has a tolerance of between about 0.041 to 0.06 mm greater than a given diameter. The inner surface 43 of the metal ring 41 has a diameter tolerance in accordance with DIN tolerance r6 which prescribes that the surface has a tolerance of between about 0 to 0.025 mm greater than the given diameter. Thus in the case of a disc having the specific dimensions set forth above, the outer surface 38 of the body member 36 has a diameter tolerance of between about 58.041 to 58.06 mm, and the inner surface 43 of the metal ring 41 has a diameter tolerance of between about 58.0 to 58.025 mm. The opposite side edges of the surfaces 38 and 43 are preferably beveled at an angle of about 10° with respect to the central axis, and so as to extend for a distance of between about 0.3 to 0.5 mm in the radial direction. These bevels facilitate the assembly of the ring assembly onto the body member.

In the illustrated embodiment, the plastic ring 45 includes opposite side edges of the outer surface 48 which are beveled, and it also includes a radially extending annular groove 50 disposed in the medial portion of the outer surface thereof, which facilitates cooling of the disc. The plastic material of the ring 45 may be composed of a suitable rubber or polymeric material, such as the polyurethane material manufactured by the firm Freudenberg in Germany under the trade designation Simritan 95AU19785. This material exhibits a hardness of 52 Shore D.

Figure 8:
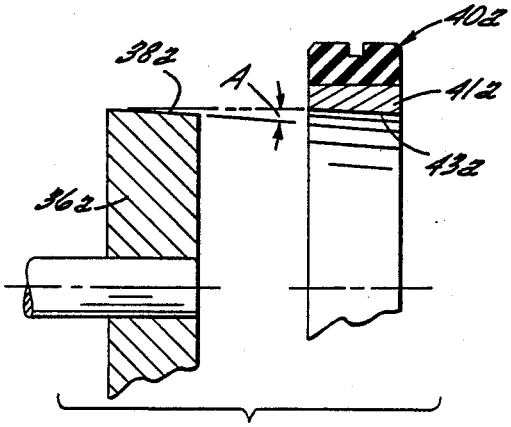
FIG. 8 is a fragmentary exploded view of a second embodiment of a disc in accordance with the present invention.
Figure 9:
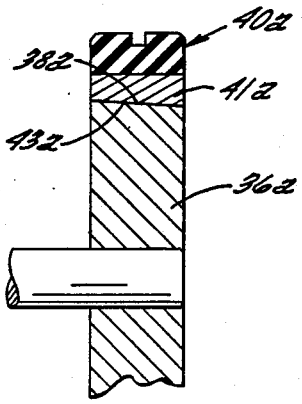
FIG. 9 is a view similar to FIG. 8 but illustrating the disc in assembled relationship.

FIGS. 8 and 9 illustrate a second embodiment of the invention, which is generally the same as the above described embodiment except that the contacting surfaces **38*a*, 43*a* of the body member 36*a* and the metal ring 41*a* respectively, are each in the form of a segment of a cone, so as to define an angle A of between about 1° to 5° with respect to the central axis when viewed in cross section. An angle which is substantially within these parameters permits the ring assembly 40*a* to be joined to the body member 36*a* by pressing the members together in the manner apparent from FIGS. 8 and 9, thereby resulting in a self-holding Morse-type interconnection. To subsequently remove the ring assembly 40*a* from the body member 36*a***, it is only usually necessary to lightly tap the ring assembly in an axial direction to release the interconnection.

In order to effect a replacement of the ring assemblies of the discs of the two support assemblies in accordance with the present invention, the frame of the apparatus at the associated spinning position is first opened, and the spinning rotor 12 withdrawn forwardly, i.e. to the right as seen in FIG. 1. The bracket 24 may then be released, which permits the two support assemblies 16 to be removed.

Once the assemblies 16 are removed from the spinning frame, the ring assemblies 40 or **40*a* of each disc may be separated from the body member 36 or 36*a* by tapping or applying a steady force to the ring assembly in the axial direction and until the self-holding interconnection is released. When separated, a new ring assembly can be immediately assembled to the body member, or the original ring assembly can be reprocessed by removing the worn plastic ring, and then joining a new plastic ring in its place, which may include a heating or vulcanizing operation to cure the plastic material. The reconditioned ring assembly can then be reassembled to the body member. As will be apparent, the press fit connection between the support shaft 18 and the body member 36 or 36*a* is not disturbed, nor is the bearing 20** subjected to any heat of vulcanization.

In the drawings and specification, there has been set forth a preferred embodiment of the invention, and although specific terms are employed, they are used in a generic and descriptive sense only and not for purposes of limitation.

I claim

1. A support assembly adapted to be mounted in adjacent pairs to form a wedge shaped cusp for rotatably supporting a shaft of a spinning rotor of an open end yarn spinning apparatus, and comprising a metallic support shaft defining a central axis, a bearing mounted on said support shaft for rotatably mounting said shaft to the frame of the yarn spinning apparatus, a pair of discs mounted to said support shaft on respective opposite sides of said bearing, with each of said discs comprising:

(a) an annular metal body member having a central bore coaxially receiving said shaft so as to be fixedly mounted thereto, and with said body member having an annular outer surface which is cylindrical and concentric to said central bore and to said central axis of said shaft, (b) an annular metal ring mounted coaxially upon said outer surface of said body member, with said metal ring having an outer peripheral surface and an inner surface, with said inner surface of said metal ring being cylindrical and contacting and engaging said outer surface of said body member so as to form a self holding and releasable press fit interconnection between said metal ring and said body member, and (c) an annular plastic ring fixedly mounted upon said outer peripheral surface of said metal ring, whereby said metal ring and said plastic ring of each disc may be removed as a unit from the associated body member to facilitate the replacement of said plastic ring.

2. The support assembly as defined in claim 1 wherein said support shaft is fixedly received in said central bore of said body member by means of a press fit.

3. The support assembly a defined in claim 2 wherein said outer surface of said body member of each disc has a diameter tolerance of between about 0.041 to 0.06 mm greater than a given diameter, and wherein said inner surface of said metal ring of each disc has a diameter tolerance of between about 0 to 0.025 mm greater than said given diameter.

4. The support assembly as defined in claim 3 wherein said given diameter is about 58 mm, and the radial thickness of said metal ring and said plastic ring totals about 6 mm for each of said discs.

5. The support assembly as defined in claim 3 wherein said outer surface of said body member and said inner surface of said metal ring of each disc each have opposite side edges which are beveled, with each of said bevels extending at an angle of about 10° with respect to said central axis and extending between about 0.3 to 0.5 mm in the radial direction.

6. The support assembly as defined in claim 3 wherein the ratio between (a) the radial distance between said central axis and said outer surface of said annular body member, and (b) the radial thickness of said metal ring, is greater than about 10 for each of said discs.

7. The support assembly as defined in claim 6 wherein the ratio between (a) the radial thickness of said plastic ring and (b) the radial thickness of said metal ring is greater than about 1.

8. A support assembly adapted to be mounted in adjacent pairs to form a wedge shaped cusp for rotatably supporting a shaft of a spinning rotor of an open end yarn spinning apparatus, and comprising a metallic support shaft defining a central axis, a bearing mounted on said support shaft for rotatably mounting said shaft to the frame of the yarn spinning apparatus, a pair of discs mounted to said support shaft on respective opposite sides of said bearing, with each of said discs comprising (a) an annular metal body member having a central bore coaxially receiving said shaft so as to be fixedly mounted thereto, and with said body member having an outer uninterrupted, conical surface which is concentric to said central bore and to said central axis of said shaft, (b) an annular metal ring mounted coaxially upon said outer conical surface of said body member, with said metal ring having an outer peripheral surface and an inner uninterrupted conical surface, with said inner conical surface contacting said outer conical surface of said body member, and with said contacting conical surfaces being correspondingly tapered so as to form a self holding and releasable interconnection between said ring and said body member, and (c) an annular plastic ring fixedly mounted upon said outer peripheral surface of said metal ring, whereby said metal ring and said plastic ring of each disc may be removed as a unit from the associated body member to facilitate the replacement of said plastic ring.

9. The support assembly as defined in claim 8 wherein contacting conical surfaces of said body member and said metal ring of each disc define an angle of between about 1° to 5° with respect to said central axis.

10. The support assembly as defined in claim 9 wherein said support shaft is fixedly received in said central bore of said body member by means of a press fit.

11. An annular ring assembly adapted to be coaxially and releasably mounted upon an outer annular surface of a supporting metal body member to thereby form a disc which is adapted to rotatably engage and support a shaft of a spinning rotor of an open end yarn spinning apparatus or the like, said annular ring assembly comprising an annular metal ring have an outer cylindrical surface and an annular inner surface, an annular plastic ring, said annular plastic ring having an inner cylindrical surface fixedly mounted upon said outer cylindrical surface of said metal ring, and an outer cylindrical surface, and wherein the ratio of the radius of said annular inner surface of said metal ring to the total radial thickness of said metal ring and said plastic ring is at least about 4.

12. The annular ring assembly as defined in claim 11 the ratio between the radial thickness of said plastic ring to the radial thickness of said metal ring is greater than about 1.

13. The annular ring assembly as defined in claim 12 wherein said metal ring and said plastic ring each have a width of about 10 mm.

14. The annular ring assembly as defined in claim 11 wherein said radius of said annular inner surface of said metal ring is about 29 mm, and the total radial thickness of said metal ring and said plastic ring is about 6 mm.

15. The annular ring assembly as defined in claim 11 wherein said plastic ring has a hardness of about 52 Shore D.

16. The annular ring assembly as defined in claim 11 wherein said outer cylindrical surface of said plastic ring includes opposite side edges which are beveled, and said plastic ring further includes a radially extending annular groove disposed in the medial portion of said outer cylindrical surface thereof.

17. The annular ring assembly as defined in claim 11 wherein said inner surface of said metal ring is cylindrical and is coaxially disposed about a central axis defined by said outer cylindrical surface of said metal ring.

18. The annular ring assembly as defined in claim 11 wherein said inner surface of said metal ring is conical and uninterrupted and so as to define an angle of between about 1° to 5° with respect to a central axis defined by said outer cylindrical surface of said metal ring.

* * * * *

UNITED STATES PATENT AND TRADEMARK OFFICE

CERTIFICATE OF CORRECTION

PATENT NO. : 4,892,422

DATED : January 9, 1990

INVENTOR(S) : Peter H. Stahlecker

It is certified that error appears in the above-identified patent and that said Letters Patent is hereby corrected as shown below:

On the face of the patent under "References Cited", please add the following patents:

| | | | | |
|---|---|---|---|---|
| -- | 1,067,744 | 7/1913 | Lane | 301/18 -- |
| -- | 1,144,260 | 1/1915 | Stehr | 301/25 -- |
| -- | 2,233,562 | 3/1941 | Tannewitz | 474/192 -- |
| -- | 2,521,731 | 9/1950 | Kennedy | 384/213 -- |
| -- | 2,730,222 | 1/1956 | Klein | 193/37 -- |
| -- | 3,384,356 | 5/1968 | Durinck | 384/549 -- |
| -- | 4,516,396 | 5/1985 | Stahlecker et al | 57/407 -- |
| -- | 4,676,673 | 6/1987 | Stahlecker et al | 57/103 -- |

In the Claims

Column 6, line 60, delete "a" and insert -- as --.

Column 7, line 53, before "contacting" insert -- said --.

Signed and Sealed this

Ninth Day of April, 1991

*Attest:*

*Attesting Officer*

HARRY F. MANBECK, JR.

*Commissioner of Patents and Trademarks*